US008593074B2

(12) United States Patent
Hatley et al.

(10) Patent No.: US 8,593,074 B2
(45) Date of Patent: Nov. 26, 2013

(54) SYSTEMS AND METHODS FOR CONTROLLING AN OUTPUT OF A LIGHT FIXTURE

(75) Inventors: Troy Bryan Hatley, Lodi, WI (US); Timothy George Robbins, Lodi, WI (US); Mike Wood, Austin, TX (US)

(73) Assignee: Electronic Theater Controls, Inc., Middleton, WI (US)

( * ) Notice: Subject to any disclaimer, the term of this patent is extended or adjusted under 35 U.S.C. 154(b) by 445 days.

(21) Appl. No.: 13/004,922

(22) Filed: Jan. 12, 2011

(65) Prior Publication Data

US 2012/0176063 A1 Jul. 12, 2012

(51) Int. Cl.
*H05B 37/00* (2006.01)

(52) U.S. Cl.
USPC ..... 315/291; 315/307; 315/308; 315/312

(58) Field of Classification Search
USPC ..... 315/291, 307, 308, 312, 314, 316, 319, 315/317, 318
See application file for complete search history.

(56) References Cited

U.S. PATENT DOCUMENTS

| | | | |
|---|---|---|---|
| 5,350,977 | A | 9/1994 | Hamamoto et al. |
| 5,636,303 | A | 6/1997 | Che et al. |
| 6,510,995 | B2 | 1/2003 | Muthu et al. |
| 6,572,977 | B1 | 6/2003 | Pavelka et al. |
| 6,576,881 | B2 | 6/2003 | Muthu et al. |
| 6,603,271 | B2 | 8/2003 | Noh |
| 6,683,423 | B2 | 1/2004 | Cunningham |
| 6,888,322 | B2 | 5/2005 | Dowling et al. |
| 6,967,447 | B2 | 11/2005 | Lim et al. |
| 7,012,382 | B2 | 3/2006 | Cheang et al. |
| 7,023,543 | B2 | 4/2006 | Cunningham |
| 7,030,574 | B2 | 4/2006 | Lim et al. |
| 7,067,995 | B2 | 6/2006 | Gunter et al. |

(Continued)

FOREIGN PATENT DOCUMENTS

| | | |
|---|---|---|
| DE | 102007059130 | 6/2009 |
| JP | 20098110715 | 5/2009 |

(Continued)

OTHER PUBLICATIONS

International Preliminary Report on Patentability for Application No. PCT/US2011/063965 dated Jan. 15, 2013 (5 pages).

(Continued)

*Primary Examiner* — David H Vu
(74) *Attorney, Agent, or Firm* — Michael Best & Friedrich LLP

(57) ABSTRACT

Systems and methods for controlling an output of a light fixture. A light fixture of one construction includes four or more light sources and is configured to produce an output that mimics the color temperature changes of an ideal black-body radiator based on one or more input parameters. The input parameters correspond to, for example, a desired target color and an intensity for the desired target color. A white point setting is determined based on the one or more input parameters and a relationship between the one or more input parameters and the color temperature of an ideal black-body radiator. A color temperature transform is selected based on the white point color temperature setting, and is used to determine a color coordinate corresponding to a modified target color. A set of light source output values corresponding to the modified target color are identified, and the light sources are driven to the identified output values.

20 Claims, 9 Drawing Sheets

(56) References Cited

U.S. PATENT DOCUMENTS

| | | | | |
|---|---|---|---|---|
| 7,178,941 | B2 | 2/2007 | Roberge et al. | |
| 7,230,222 | B2 | 6/2007 | Cheng et al. | |
| 7,233,831 | B2 | 6/2007 | Blackwell | |
| 7,288,902 | B1 | 10/2007 | Melanson | |
| 7,319,298 | B2 | 1/2008 | Jungwirth et al. | |
| 7,348,949 | B2 | 3/2008 | Lee et al. | |
| 7,354,172 | B2 | 4/2008 | Chemel et al. | |
| 7,358,961 | B2 | 4/2008 | Zwanenburg | |
| 7,387,405 | B2 | 6/2008 | Ducharme et al. | |
| 7,394,210 | B2 | 7/2008 | Ashdown | |
| 7,513,671 | B2 | 4/2009 | Ng et al. | |
| 7,521,872 | B2 | 4/2009 | Bruning | |
| 7,560,677 | B2 | 7/2009 | Lyons et al. | |
| 7,573,209 | B2 | 8/2009 | Ashdown et al. | |
| 7,598,684 | B2 | 10/2009 | Lys et al. | |
| 7,598,686 | B2 | 10/2009 | Lys et al. | |
| 7,604,378 | B2 | 10/2009 | Wolf et al. | |
| 7,619,193 | B2 | 11/2009 | Deurenberg | |
| 7,619,370 | B2 | 11/2009 | Chemel et al. | |
| 7,638,956 | B2 | 12/2009 | Liu et al. | |
| 7,710,369 | B2 | 5/2010 | Dowling | |
| 7,718,942 | B2 | 5/2010 | Lim et al. | |
| 7,759,854 | B2 | 7/2010 | Miller et al. | |
| 7,759,882 | B2 | 7/2010 | Korcharz et al. | |
| 7,767,948 | B2 | 8/2010 | May et al. | |
| 7,781,979 | B2 | 8/2010 | Lys | |
| 7,786,678 | B2 | 8/2010 | Kurt et al. | |
| 7,868,562 | B2 * | 1/2011 | Salsbury et al. | 315/307 |
| 8,022,632 | B2 | 9/2011 | Schulz et al. | |
| 8,084,948 | B2 | 12/2011 | Van Der Veen et al. | |
| 2002/0171373 | A1 * | 11/2002 | Muthu | 315/219 |
| 2004/0212320 | A1 | 10/2004 | Dowling et al. | |
| 2005/0062446 | A1 | 3/2005 | Ashdown | |
| 2005/0151489 | A1 | 7/2005 | Lys et al. | |
| 2005/0218838 | A1 | 10/2005 | Lys | |
| 2006/0049782 | A1 * | 3/2006 | Vornsand et al. | 315/312 |
| 2006/0139914 | A1 | 6/2006 | Yoganandan et al. | |
| 2006/0187236 | A1 | 8/2006 | Runnels et al. | |
| 2006/0226795 | A1 | 10/2006 | Walter et al. | |
| 2006/0226956 | A1 | 10/2006 | Young et al. | |
| 2006/0237636 | A1 | 10/2006 | Lyons et al. | |
| 2006/0290710 | A1 | 12/2006 | Zwanenburg | |
| 2007/0076014 | A1 | 4/2007 | De Vaan | |
| 2007/0235639 | A1 | 10/2007 | Rains, Jr. | |
| 2008/0203945 | A1 | 8/2008 | Deurenberg et al. | |
| 2008/0218095 | A1 | 9/2008 | Erhardt | |
| 2008/0246419 | A1 | 10/2008 | Deurenberg | |
| 2009/0174332 | A1 | 7/2009 | Sejkora | |
| 2009/0315476 | A1 | 12/2009 | Baaijens | |
| 2010/0002440 | A1 | 1/2010 | Negley et al. | |
| 2010/0027257 | A1 | 2/2010 | Boonekamp et al. | |
| 2010/0052560 | A1 | 3/2010 | Li et al. | |
| 2010/0060171 | A1 | 3/2010 | Goitiandia et al. | |
| 2010/0079059 | A1 | 4/2010 | Roberts et al. | |
| 2010/0097406 | A1 | 4/2010 | Zulch | |
| 2010/0097407 | A1 | 4/2010 | Zulch | |
| 2010/0110672 | A1 | 5/2010 | Durand et al. | |
| 2010/0128472 | A1 | 5/2010 | Hancock et al. | |
| 2010/0171444 | A1 | 7/2010 | Bennette | |
| 2010/0188022 | A1 | 7/2010 | Gerlach et al. | |
| 2010/0259175 | A1 | 10/2010 | Forster et al. | |
| 2011/0187290 | A1 | 8/2011 | Krause | |
| 2012/0081010 | A1 | 4/2012 | Hatley | |
| 2013/0154516 | A1 | 6/2013 | Hatley et al. | |

FOREIGN PATENT DOCUMENTS

| | | |
|---|---|---|
| WO | 2006/069002 | 6/2006 |
| WO | 2007/033667 | 3/2007 |
| WO | 2007083250 | 7/2007 |
| WO | 2008/006205 | 1/2008 |
| WO | 2008/068713 | 6/2008 |
| WO | 2008/072138 | 6/2008 |
| WO | 2008/078274 | 7/2008 |
| WO | 2008/142622 | 11/2008 |
| WO | 2009/024903 | 2/2009 |
| WO | 2010/080651 | 7/2010 |
| WO | 2012/096733 | 7/2012 |
| WO | 2012/096734 | 7/2012 |

OTHER PUBLICATIONS

International Written Opinion for Application No. PCT/US2011/063961 dated Jan. 15, 2013 (7 pages).
International Search Report and Written Opinion for Applicatino No. PCT/US2011/054747 dated Mar. 15, 2012 (10 pages).
International Search Report and Written Opinion for Application No. PCT/US2011/063965 dated Feb. 28, 2012 (9 pages).
International Search Report and Written Opinion for Application No. PCT/US2011/063961 dated Apr. 27, 2012 (10 pages).
Copending U.S. Appl. No. 13/004,931, filed Jan. 12, 2011.
International Preliminary Report on Patentability for Application No. PCT/US2011/063961 dated Apr. 5, 2013 (8 pages).
United States Patent Office Action for U.S. Appl. No. 13/766,827 dated May 3, 2013 (6 pages).
United States Patent Office Action for U.S. Appl. No. 12/898,127 dated Jul. 18, 2012 (7 pages).
United States Patent Office Notice of Allowance for U.S. Appl. No. 12/898,127 dated Oct. 24, 2012 (6 pages).
Notification concerning informal communications with the applicant for Application No. PCT/US2011/054747 dated Oct. 10, 2012 (5 pages).
International Preliminary Report on Patentability for Application No. PCT/US2011/054747 dated Nov. 12, 2012 (21 pages).
United States Patent Office Action for U.S. Appl. No. 13/004,931 dated Aug. 16, 2013 (6 pages).

* cited by examiner

SYSTEMS AND METHODS FOR CONTROLLING AN OUTPUT OF A LIGHT FIXTURE

BACKGROUND

This invention relates to controlling an output of a light fixture.

The color temperature of a white-light light source (e.g., an incandescent light bulb) corresponds to the temperature of an ideal black-body radiator that radiates light of a comparable hue, and is identified in units of absolute temperature, Kelvin ("K"). Color temperatures of approximately 5,000K or greater are referred to as cool colors, and color temperatures between approximately 2,700K and 3,000K are referred to as warm colors. For example, the light output by an incandescent light bulb is thermal radiation and approximates an ideal black-body radiator. The color temperatures associated with the incandescent light bulb follow the Planckian locus through a particular color space (e.g., the CIE xyY color space) from low color temperatures (i.e., warm colors) to high color temperatures (i.e., cool colors). Accordingly, color temperature is a convenient way to describe the output of an incandescent light bulb or other similar white-light light sources.

SUMMARY

Although color temperature is convenient for describing the output of white-light light sources, color temperature is undefined with respect to light sources that do not approximate, or cannot be correlated to, ideal black-body radiators (e.g., red light emitting diodes ("LEDs"), green LEDs, blue LEDs, etc.). Such light sources cannot be individually described with respect to a color temperature. Although systems have been developed that use discrete color light sources (e.g., LEDs) to approximate white-light light sources, such systems are unable to produce a non-white output that mimics the color temperature changes of an ideal black-body radiator.

As such, the invention provides systems and methods for controlling an output of a light fixture. The light fixture includes four or more light sources. The light fixture, or a controller connected to the light fixture, is configured to produce an output that mimics the color temperature changes of an ideal black-body radiator based on a desired target color, a white point color temperature setting, and an intensity value. For example, input parameters corresponding to the desired target color and the intensity for the desired target color are inputted using a color control methodology (e.g., HSI, RGB, etc.). The white point color temperature setting is then determined based on the intensity value and a relationship between the intensity value and the color temperature of an ideal black-body radiator. A color temperature transform is then determined, selected, or identified based on the white point color temperature setting. The color temperature transform and the desired target color are used to determine a modified target color point within a color space (e.g., the CIE xyY color space). A set of light source output intensity values corresponding to the modified target color point are then identified, and the light sources are driven to the identified output intensity values.

In one implementation, the invention provides a method of controlling an output of a light fixture. The light fixture includes four or more light sources. The method includes receiving a first input parameter corresponding to a first color point within a color space, receiving a second input parameter associated with a desired intensity for the first color point, and determining a white point based on a relationship between the second input parameter and the color temperature of a black-body radiator. The white point corresponds to a second color point within the color space, and a color temperature transform is selected based on the white point. The method also includes calculating a third color point within the color space based on the color temperature transform, determining a respective light source output value for each of the four or more light sources based on the third color point, and driving each of the four or more light sources at the respective light source output value to produce the output of the light fixture. The color temperature transform defines a relationship between the first color point and the third color point. The third color point is different than the first color point, and the third color point is different than the second color point.

In another implementation, the invention provides a method of controlling an output of a light fixture. The light fixture includes four or more light sources. The method includes receiving a set of input parameters. The set of input parameters correspond to a first color point within a color space and an intensity for the first color point. The method also includes determining a color temperature setting based on a relationship between the set of input parameters and the color temperature of a black-body radiator. The color temperature setting corresponds to a second color point within the color space. A color temperature transform is determined based on the color temperature setting, and a third color point within the color space is calculated based on the color temperature transform. The color temperature transform defines a relationship between the first color point and the third color point. The third color point is different than the first color point, and the third color point is different than the second color point. The method also includes determining a respective light source output value for each of the four or more light sources based on the third color point, and driving each of the four or more light sources at the respective light source output value to produce the output of the light fixture.

In one construction, the invention provides a system for controlling the output of a light fixture. The system includes four or more light sources and a controller. The controller is configured to receive a first input parameter corresponding to a first color point within a color space, receive a second input parameter associated with a desired intensity for the first color point, and determine a white point based on a relationship between the second input parameter and the color temperature of a black-body radiator. The white point corresponds to a second color point within the color space, and a color temperature transform is selected based on the white point. The controller is also configured to calculate a third color point within the color space based on the color temperature transform, determine a respective light source output value for each of the four or more light sources based on the third color point, and drive each of the four or more light sources at the respective light source output value to produce the output of the light fixture. The color temperature transform defines a relationship between the first color point and the third color point. The third color point is different than the first color point, and the third color point is different than the second color point.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

The invention described herein relates to systems and methods for controlling an output of a light fixture. The light fixture includes four or more light sources. The light fixture, or a controller connected to the light fixture, is configured to produce an output that mimics the color temperature changes of an ideal black-body radiator based on one or more input parameters (e.g., a desired target color, a white point color temperature setting, an intensity value, etc.). For example, the input parameters corresponding to a desired target color and an intensity value for the desired color are inputted using one or more color control methodologies (e.g., HSI, RGB, etc.). The desired target color corresponds to a first color point or coordinate within a color space (e.g., the CIE xyY color space), and the intensity value corresponds to an intensity for the first color point. The white point color temperature setting is then determined, selected, or calculated based on, for example, the intensity value and a relationship between the intensity value and the color temperature of an ideal black-body radiator. The white point color temperature setting corresponds to a second color point or coordinate within the color space and is used to determine, select, or identify a color temperature transform. The color temperature transform defines a relationship between the first color point and a third color point or coordinate. The color temperature transform is then used to determine the third color point within the color space. The third color point is different from the first color point and the second color point. A set of light source output intensity values corresponding to the third color point are then identified, and the light sources are driven to the identified output intensity values.

Figure 1:
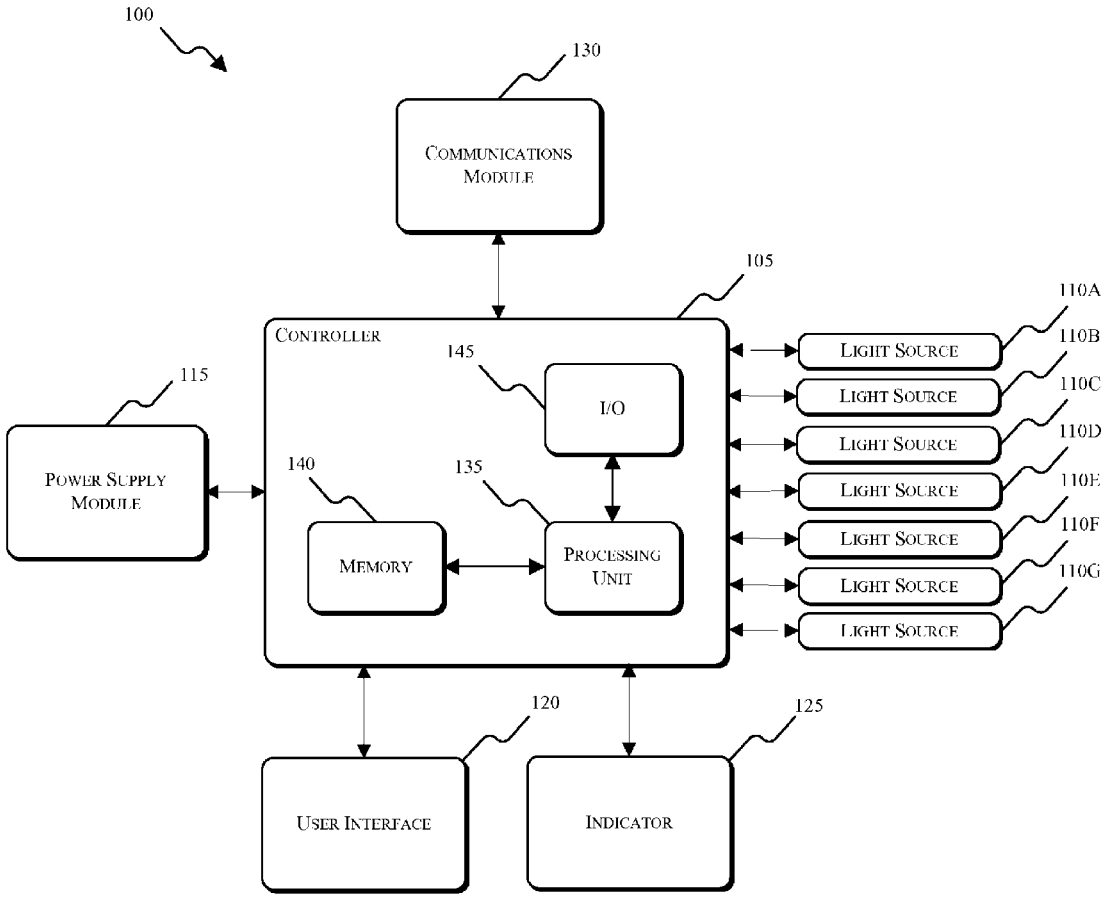
FIG. 1 is a block diagram of a light fixture.

In some implementations, light fixtures are used in, for example, a theatre, a hall, an auditorium, a studio, or the like. Each light fixture 100 includes, among other things, a controller 105, a plurality of light sources 110A-110G, a power supply module 115, a user interface 120, one or more indicators 125, and a communications module 130, as shown in FIG. 1. In the illustrated construction, the light fixture 100 includes seven light sources 110A-110G. Each light source is configured to generate light at a specific wavelength or range of wavelengths. For example, the light sources 110A-110G generate light corresponding to the colors red, red-orange, amber, green, cyan, blue, and indigo. In other constructions, light sources that generate different colors are used (e.g., violet, yellow, etc.).

The controller 105 includes, or is connected to an external device (e.g., a computer), which includes combinations of software and hardware that are operable to, among other things, control the operation of one or more of the light fixtures, control the output of each of the light sources 110A-110G, and activate the one or more indicators 125 (e.g., LEDs or a liquid crystal display ("LCD")). In one construction, the controller 105 or external device includes a printed circuit board ("PCB") (not shown) that is populated with a plurality of electrical and electronic components that provide power, operational control, and protection to the light fixtures. In some constructions, the PCB includes, for example, a processing unit 135 (e.g., a microprocessor, a microcontroller, or another suitable programmable device), a memory 140, and a bus. The bus connects various components of the PCB including the memory 140 to the processing unit 135. The memory 140 includes, for example, a read-only memory ("ROM"), a random access memory ("RAM"), an electrically erasable programmable read-only memory ("EEPROM"), a flash memory, a hard disk, or another suitable magnetic, optical, physical, or electronic memory device. The processing unit 135 is connected to the memory 140 and executes software that is capable of being stored in the RAM (e.g., during execution), the ROM (e.g., on a generally permanent basis), or another non-transitory computer readable medium such as another memory or a disc. Additionally or alternatively, the memory 140 is included in the processing unit 135. The controller 105 also includes an input/output ("I/O") system 145 that includes routines for transferring information between components within the controller 105 and other components of the light fixtures or system. For example, the communications module 130 is configured to provide communication between the light fixture 100 and one or more additional light fixtures or another control device within a lighting system.

Software included in the implementation of the light fixture 100 is stored in the memory 140 of the controller 105. The software includes, for example, firmware, one or more applications, program data, one or more program modules, and other executable instructions. The controller 105 is configured to retrieve from memory and execute, among other things, instructions related to the control processes and methods described below. For example, the controller 105 is configured to execute instructions retrieved from the memory 140 for performing a mathematical transformation of a control value to a value that is required to drive the light sources 110A-110G to produce a desired color. In other constructions, the controller 105 or external device includes additional, fewer, or different components.

The PCB also includes, among other things, a plurality of additional passive and active components such as resistors, capacitors, inductors, integrated circuits, and amplifiers. These components are arranged and connected to provide a plurality of electrical functions to the PCB including, among other things, filtering, signal conditioning, or voltage regulation. For descriptive purposes, the PCB and the electrical components populated on the PCB are collectively referred to as the controller 105.

The user interface 120 is included to control the light fixture 100 or the operation of a lighting system as a whole. The user interface 120 is operably coupled to the controller 105 to control, for example, the output of the light sources 110A-110G. The user interface 120 can include any combination of digital and analog input devices required to achieve a desired level of control for the system. For example, the user interface 120 can include a computer having a display and input devices, a touch-screen display, a plurality of knobs, dials, switches, buttons, faders, or the like. In some constructions, the user interface is separated from the light fixture 100.

The power supply module 115 supplies a nominal AC or DC voltage to the light fixture 100 or system of light fixtures. The power supply module 115 is powered by mains power having nominal line voltages between, for example, 100V and 240V AC and frequencies of approximately 50-60 Hz. The power supply module 115 is also configured to supply lower voltages to operate circuits and components within the light fixture 100. In other constructions, the light fixture 100 is powered by one or more batteries or battery packs.

As illustrated in FIG. 1, the controller 105 is connected to light sources 110A-110G. In other constructions, the controller 105 is connected to, for example, red, green, and blue ("RGB") light sources, red, green, blue, and amber ("RGBA") light sources, red, green, blue, and white ("RGBW") light sources, or other combinations of light sources. A seven light source implementation is illustrated because it is operable to reproduce substantially the entire spectrum of visible light. In other implementations, eight or more light sources are used to further enhance the light fixtures ability to reproduce visible light.

Figure 2:
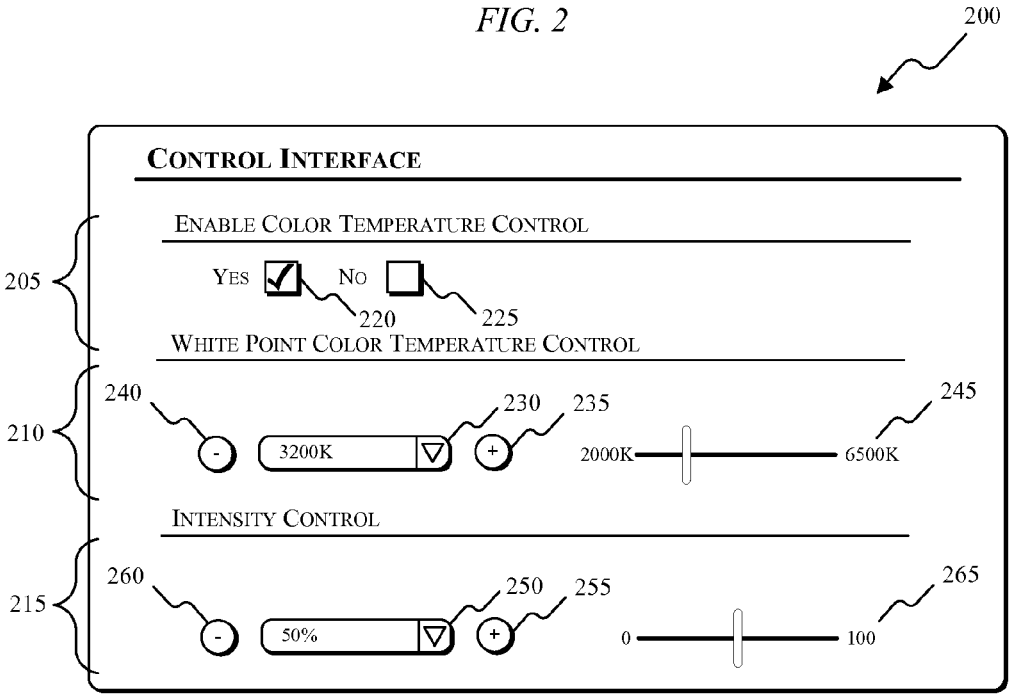
FIG. 2 is a control interface according to an embodiment of the invention.

FIG. 2 illustrates a control interface 200 for controlling the color temperature of the output of the light fixture 100. In some constructions, the control interface 200 is included in the user interface 120. The control interface 200 is, for example, a graphical user interface ("GUI") that is displayed on a monitor or a similar display. In some constructions, the control interface 200 is a physical interface and includes one or more buttons, knobs, dials, faders, or the like. The illustrated control interface 200 includes an enable color temperature control section 205, a white point color temperature control section 210, and an intensity control section 215. Although the intensity control section 215 is illustrated as being separate from, for example, target color controls (e.g., hue control, saturation control, individual light source control, etc.), the intensity control section 215 can alternatively be included with the target color controls. The enable color temperature control section 205 includes a YES checkbox 220 and a NO checkbox 225. The checkboxes 220 and 225 are used to select or deselect automatic color temperature control. As described in greater detail below, the automatic color temperature control is configured to automatically modify a user selected target color to mimic the color temperature changes of an ideal black-body radiator. Once enabled, the color temperature control can use a white point setting from the white point color temperature control section 210 to modify a target color to produce an output of the light fixture that mimics the color temperature changes of a black-body radiator. Additionally or alternatively, an intensity setting from the intensity control section 215 can be used to modify a target color to produce an output of the light fixture that mimics the color temperature changes of a black-body radiator.

The white point color temperature control section 210 includes a white point input portion 230, an increment button 235, a decrement button 240, and a fader 245. The white point input portion 230 is controlled by directly selecting and modifying a white point setting for the output of the light fixture. For example, a user is able to modify or populate the white point input portion 230 with a desired white point color temperature (i.e., a value in Kelvin). The user populates the white point input portion 230 by entering text via a mechanical or virtual keyboard of a computer or similar processing device, and using a pointing or selection device such as a mouse to control a curser on the display. Input signals from the keyboard and the mouse are received, processed, and translated into a visual result or action in the interface 200. For example, if the user enters text using a keyboard, the activated keys produce signals which are represented as type-written text in the interface 200. Similarly, a mouse click, which corresponds to a location of the cursor on the screen, results in selecting/deselecting the increment button 235, the decrement button 240, a dropdown menu, the position of the fader 245, etc. In other implementations, the interface 200 is accessed and controlled using a touch-screen device and a user's finger strokes or tapping are used to populate or modify the white point input portion 230.

Like the white point color temperature control section 210, the intensity control section 215 includes an intensity input portion 250, an increment button 255, a decrement button 260, and a fader 265. The intensity input portion 250 is controlled by directly selecting and modifying an intensity setting or value for the target color. For example, a user is able to modify or populate the intensity input portion 250 with a desired intensity setting or value (e.g., a percent). The intensity input portion 250 is modified or populated in a manner similar to that described above with respect to the white point input portion 230.

Figure 3:
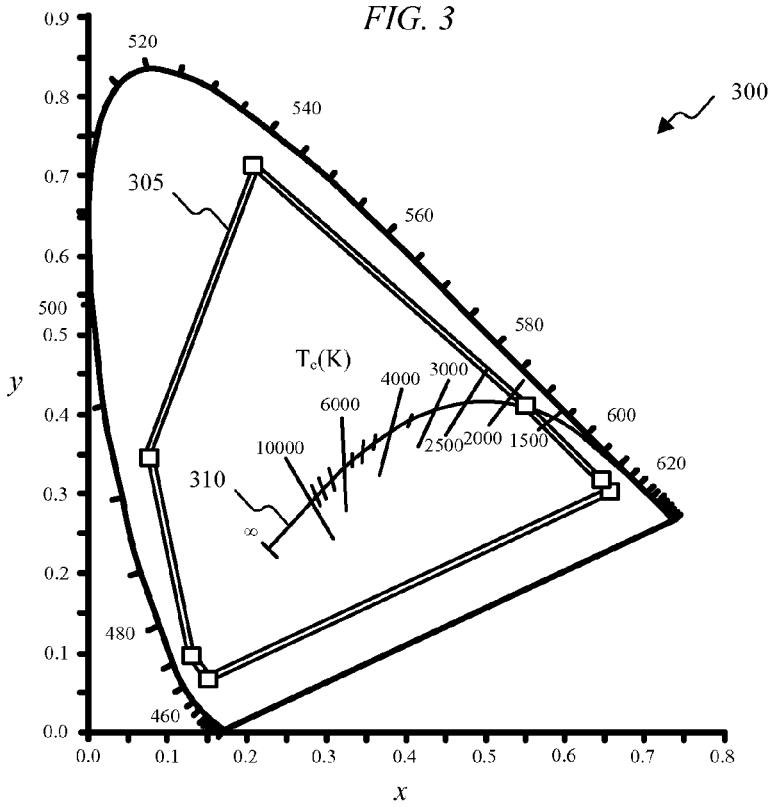
FIG. 3 is the International Commission on Illumination ("CIE") 1931 color space chromaticity diagram and illustrates a gamut of a light fixture.
Figure 4:
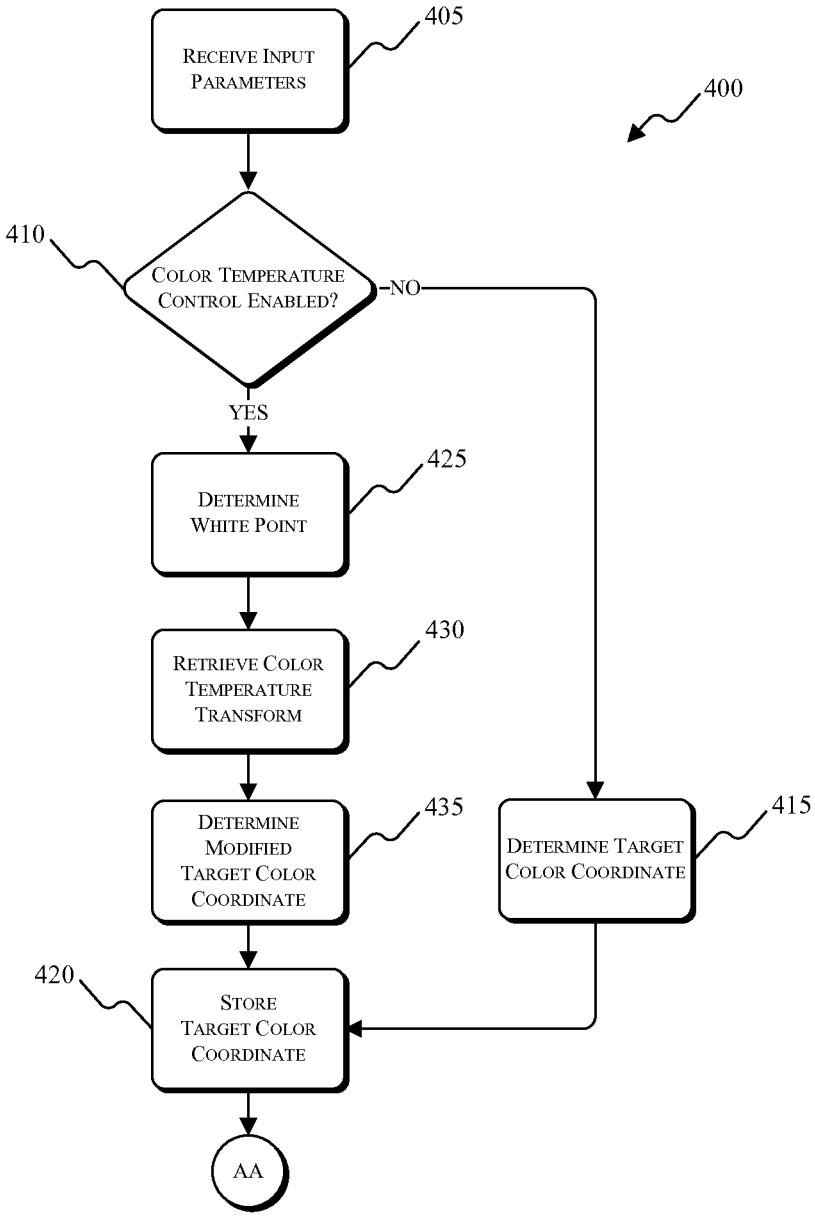
FIGS. 4-10 are a process for controlling an output of a light fixture.

FIG. 3 illustrates the CIE xyY color space 300 and the available color gamut 305 for the light fixture 100. As such, only colors that fall within or on the illustrated color gamut 305 are reproducible by the light fixture 100. Also illustrated is the Planckian locus 310, which illustrates the various color temperatures for an idea black-body radiator.

The CIE xyY color space 300 represents x-coordinates with values between 0.0 and 0.8, and y-coordinates with values between 0.0 and 0.9. To avoid floating point calculations, 16-bit integers are used in some constructions to represent both the x-coordinate and the y-coordinate. An integer value of zero corresponds to a coordinate of 0.0, and an integer value of 32,767 corresponds to a coordinate of 1.0. Therefore, some constructions of the invention achieve a resolution of $1/32{,}767$ or approximately 0.00003.

The invention can be implemented using a variety of color control, targeting, and matching methodologies, such as HSI, RGB, CYM, YIQ, YUV, HSV, HLS, XYS, etc. The techniques described below are exemplary, and other techniques for controlling the output of the light fixture 100 to mimic the color temperature changes of an ideal black-body radiator are within the spirit and scope of the invention. Additionally, the invention is capable of being implemented internal to or external from the light fixture 100. For example, the light fixture 100 can include sufficient memory and processing power to execute one or more programs associated with the inventive methods. Additionally or alternatively, a separate computer (e.g., a central computer, a control panel, a controller, etc.) includes sufficient memory and processing power to execute one or more programs associated with the inventive methods.

FIGS. 4-10 are a process 400 for controlling an output of a light fixture to mimic the color temperature changes of an ideal black-body radiator. The steps of the process 400 are described in an iterative manner for descriptive purposes. Various steps described herein with respect to the process 400 are capable of being executed simultaneously, in parallel, or in an order that differs from the illustrated serial and iterative manner of execution. A target color and various parameters associated with the target color, the output of the light fixture, settings of the light fixture, etc. are inputted as one or more input parameters (e.g., a set of input parameters) (step 405) to the light fixture using a complex color control methodology (e.g., HSI, RGB, etc.). The target color corresponds to a target color point or coordinate within a color space, such as the CIE xyY color space. The input parameters are received from, for example, a controller or user interface (e.g., the user interface 120), which allows a user to enter a desired target color, a hue setting, a saturation setting, a white point setting, an intensity setting, individual light source settings, etc. Additionally or alternatively, the controller receives or retrieves a desired target color, a hue setting, a saturation setting, a white point setting, an intensity setting, individual light source settings, etc. from memory (e.g., as part of a program or sequence of desired colors and settings). In some implementations, the input parameters can be stored in either a volatile or non-volatile memory. For example, if one or more of the input parameters have already been stored to a non-volatile memory (e.g., a ROM), the stored one or more input parameters can be retrieved and stored in, for example, a RAM or similar memory used to store information necessary for the execution of the process 400.

Following step 405, light fixture 100 or a controller connected to the light fixture 100 determines whether color temperature control is enabled (step 410). For example, the color temperature control can be enabled using the control interface 200 described above with respect to FIG. 2. In some implementations, selecting the YES checkbox 220 in FIG. 2 causes an indicator (e.g., a flag, a bit, etc.) to be set. In such implementations, a flag or a bit set to a value of "1" can indicate that the color temperature control is enabled. In other implementations, setting the YES checkbox 220 sets a software pointer to a desired program associated with color temperature control. For example, if the NO checkbox 225 in FIG. 2 is selected, the pointer points to, or causes to be accessed, a software program that does not include executable instructions for controlling the output of the light fixture to mimic color temperature changes. If the YES checkbox 220 is selected, the pointer points to, or causes to be accessed, a software program that includes executable instructions associated with the control of the output of the light fixture to mimic color temperature changes.

If, at step 410, the color temperature control is not enabled, the input parameters are used to determine a target color point or coordinate (step 415) within a color space (e.g., the CIE xyY color space) using, for example, a standard color space conversion (e.g., based on tristimulus values). The target color coordinate substantially corresponds to the desired target color. The tristimulus values correspond to the amounts of three primary colors in a three-component additive color model that are needed to match a target color. The tristimulus values, denoted by X, Y, and Z, are derived parameters that are used to represent the human eye's response to red, green, and blue colors and are calculated using three corresponding color matching functions. The target color coordinate is determined based on the calculated tristimulus values and includes an x-coordinate and a y-coordinate which correspond to a location within the color space (see FIG. 3). The target color coordinate is then stored in memory (step 420).

If the color temperature control is enabled at step 410, a white point color temperature setting for the output of the light fixture is determined (step 425). The white point color temperature setting corresponds to a white point color coordinate within the color space that substantially lies on the Planckian locus. In some implementations, the white point color coordinate is different from the target color coordinate (e.g., the target color coordinate does not substantially lie on the Planckian locus). In other implementations, the white point color coordinate is the same as the target color coordinate. As described above, the control interface 200 can be used to set or select a white point color temperature or an intensity value. Additionally or alternatively, a predetermined or preselected white point color temperature setting (e.g., a default white point color temperature setting) can be retrieved from memory. In some implementations, the intensity value is used to determine the white point color temperature setting. For example, depending on the intensity value, one of a plurality of calculated or predetermined white point color temperatures is selected. In other implementations, a white point color temperature is selected using the control interface 200, and the intensity value is used to scale the selected white point color temperature. For example, the selected white point color temperature can be set as a maximum white point color temperature. As the intensity value is decreased, the user-selected white point color temperature is decreased. Additional selection techniques can also be used. For example, the user-selected white point color temperature may correspond to 50% intensity. In such an implementation, as the intensity value is increased, the white point color temperature is increased, and as the intensity value is decreased, the white point color temperature is decreased.

In some implementations, the white point color temperature setting is set using the intensity input portion 250 described above with respect to FIG. 2. For example, the intensity input portion 250 and the control interface 200 are used to generate a signal corresponding to a desired intensity value (i.e., an input parameter) that is received by a controller (e.g., the controller 105). The desired intensity value is correlated to a color temperature based on one or more relationships (e.g., estimations, interpolations, extrapolations, regressions, least squares approximations, linear approximations, non-linear approximations, Taylor series, power series, etc.). As an illustrative example of a relationship between an intensity value and a color temperature, the desired intensity value is converted to a desired intensity value in lumens. An exemplary conversion is provided below in EQN. 1.

$$\text{Lumens} = \text{Max Lumens} \times \left(\frac{\text{Actual Intensity}}{\text{Max Intensity}}\right)^X \qquad \text{EQN. 1}$$

where the maximum intensity is the maximum intensity setting for the light fixture (e.g., 255 for an 8-bit input value), the actual intensity is the intensity value setting based on the input parameter, the maximum lumens is the maximum lumen setting for the light fixture, and the exponent, X, has a value that is based on a manner in which the intensity of the light fixture is dimmed.

The desired intensity value in lumens can then be correlated to an intensity value in volts. An exemplary conversion is provided below in EQN. 2.

$$\text{Volts} = \text{Max Volts} \times \left(\frac{\text{Actual Lumens}}{\text{Max Lumens}}\right)^Y \qquad \text{EQN. 2}$$

where the maximum volts is the maximum volt reading for the light fixture, the maximum lumens is the maximum lumen setting for the light fixture (e.g., 255 for an 8-bit input value), the actual lumens is the lumen setting calculated using EQN. 1, and the exponent, Y, has a value that is based on a relationship between lumens and volts for the light fixture 100.

The intensity value in volts is then converted to a color temperature. An exemplary conversion is provided below in EQN. 3.

$$\text{Color Temperature} = \text{Max Color } Temp \times \left(\frac{\text{Actual Volts}}{\text{Max Volts}}\right)^Z \quad \text{EQN. 3}$$

where the maximum color temperature is a maximum color temperature setting for the light fixture or the maximum color temperature achievable by the light fixture. The maximum volts is the maximum volt reading for the light fixture, the actual volts is the volt setting calculated using EQN. 2, and the exponent, Z, has a value that is based a relationship between color temperature and volts for the light fixture 100. The calculated color temperature can then be associated with, or approximated to, a color space coordinate (e.g., an x-y coordinate at ($x_w$, $y_w$)) that lies on the Planckian locus and corresponds to the color temperature of an ideal black-body radiator. Each of the conversions shown in EQNS. 1-3 can be combined into a single conversion or relationship, or can be executed separately. The relationships between the intensity values and color temperature are then used to generate one or more color temperature transforms, as described below. In some implementations, the relationships between each of the intensity values and a color temperature are stored in memory. Additionally or alternatively, the color temperatures corresponding to particular intensity values are stored in memory. For example, depending on a desired resolution for the color temperature control, a predetermined number of color temperature values are stored in memory (e.g., 256 values, 65,536 values, etc.) that correspond to discrete intensity values or ranges of intensity values.

Returning to the process 400, a color temperature transform is then selected and retrieved (i.e., from memory) based on the white point color temperature (step 430), and the input parameters are used to determine a modified target color coordinate based on the color temperature transform (step 435). In some implementations, the modified target color coordinate is different from the target color coordinate and the white point color coordinate (e.g., the modified target color coordinate does not substantially lie on the Planckian locus). In other implementations, the modified target color coordinate is the same as the white point color coordinate.

The color temperature transform is configured to generate a modified target color coordinate based on the desired target color. The color temperature transform is different than the standard color space conversion described above. As an illustrative example, given a particular target color, the standard color space conversion and the color temperature transform each generate a different color space coordinate. The color space coordinate generated using the known color space conversion substantially corresponds to the target color. However, the color space coordinate generated or determined using the color temperature transform is shifted within the color space in order to mimic the color temperature changes of an ideal black-body radiator.

The color temperature transforms are generated based on a selected color gamut (e.g., the RGB color gamut) that can be defined with respect to the CIE xyY color space 300. For example, as described above, the user is able to select a desired target color based on any of a number of complex color control methodologies. The input values from the complex color control methodology are then associated with the RGB color gamut (e.g., $R_T$, $G_T$, $B_T$), which is represented by a triangle in the CIE xyY color space having a red coordinate ($x_R$, $y_R$), a green coordinate ($x_G$, $y_G$), and a blue coordinate ($x_B$, $y_B$), which have predetermined values. The red coordinate, the green coordinate, and the blue coordinate correspond to the bounds of the RGB color gamut. The red coordinate, the green coordinate, and the blue coordinate are used to generate tristimulus values associated with each coordinate, as well as generate the color temperature transforms. For example, the tristimulus values for the red coordinate can be calculated using EQNS. 4-6 below.

$$X_R = \frac{x_R}{y_R} \quad \text{EQN. 4}$$

$$Y_R = 1 \quad \text{EQN. 5}$$

$$Z_R = \frac{(1 - x_R - y_R)}{y_R} \quad \text{EQN. 6}$$

In a similar manner, the tristimulus values for the green coordinate can be calculated using EQNS. 7-9 below.

$$X_G = \frac{x_G}{y_G} \quad \text{EQN. 7}$$

$$Y_G = 1 \quad \text{EQN. 8}$$

$$Z_G = \frac{(1 - x_G - y_G)}{y_G} \quad \text{EQN. 9}$$

The tristimulus values for the blue coordinate can be calculated using EQNS. 10-12 below.

$$X_B = \frac{x_B}{y_B} \quad \text{EQN. 10}$$

$$Y_B = 1 \quad \text{EQN. 11}$$

$$Z_B = \frac{(1 - x_B - y_B)}{y_B} \quad \text{EQN. 12}$$

In some implementations, the tristimulus values for the red coordinate, the green coordinate, and the blue coordinate are calculated once and stored in memory. In other implementations, the tristimulus values are calculated continually, at predetermined intervals, or based on a user input.

After the white point color temperature and corresponding color space coordinate for the white point color temperature have been determined, as described above, tristimulus values for the white point color temperature can also be determined. For example, the tristimulus values for the white point color temperature can be calculated using EQNS. 13-15 below.

$$X_W = \frac{x_W}{y_W} \quad \text{EQN. 13}$$

$$Y_W = 1 \quad \text{EQN. 14}$$

$$Z_W = \frac{(1 - x_W - y_W)}{y_W} \quad \text{EQN. 15}$$

Using the tristimulus values for the red coordinate, the green coordinate, the blue coordinate, and the white point coordinate, a matrix of scale factors, S, can be calculated, as shown below in EQN. 16.

$$\begin{bmatrix} S_R \\ S_G \\ S_B \end{bmatrix} = \begin{bmatrix} X_R & X_G & X_B \\ Y_R & Y_G & Y_B \\ Z_R & Z_G & Z_B \end{bmatrix}^{-1} \begin{bmatrix} X_W \\ Y_W \\ Z_W \end{bmatrix} \quad \text{EQN. 16}$$

The matrix of scale factors, S, can then be used to calculate the tristimulus values associated with a modified target color, as shown below in EQN. 17.

$$\begin{bmatrix} X_W \\ Y_W \\ Z_W \end{bmatrix} = \begin{bmatrix} S_R X_R & S_G X_G & S_B X_B \\ S_R Y_R & S_G Y_G & S_B Y_B \\ S_R Z_R & S_G Z_G & S_B Z_B \end{bmatrix} \begin{bmatrix} R_T \\ G_T \\ B_T \end{bmatrix} \quad \text{EQN. 17}$$

where $R_T$, $G_T$, and $B_T$ are red, green, and blue values corresponding to the desired target color.

The x-y color coordinate (i.e., chromaticity) of the modified target color is then determined as a function of the tristimulus values $X_M$, $Y_M$, and $Z_M$, as shown below in EQNS. 18-20.

$$x_M = \frac{X_M}{(X_M + Y_M + Z_M)} \quad \text{EQN. 18}$$

$$y_M = \frac{Y_M}{(X_M + Y_M + Z_M)} \quad \text{EQN. 19}$$

$$z_M = \frac{Z_M}{(X_M + Y_M + Z_M)} = 1 - x_M - y_M \quad \text{EQN. 20}$$

In some implementations, the relationships or transforms between the target color coordinate and the modified target color coordinate described above with respect EQNS. 1-20 are combined into a single relationship to, for example, reduce processing time, processing requirements, and memory usage. In other implementations, the color temperature transforms corresponding to particular intensity values are stored in memory. For example, depending on a desired resolution for the color temperature control, a predetermined number of color temperature transforms are stored in memory (e.g., 256 transforms, 65,536 transforms, etc.) that correspond to discrete intensity values or ranges of intensity values. A color temperature transform can then be determined or retrieved from memory based on the intensity setting or stored color temperature value, and the x-y coordinate of the modified target color is determined based on the target color and the color temperature transform.

As described above, the target color coordinate determined using the color temperature transform is different from the target color coordinate that is determined using the standard conversion. As such, the target color coordinate determined using the color temperature transform is indicated as a "modified" target color coordinate. For descriptive purposes, the target color coordinate and the modified target color coordinate are each referred to as the target color coordinate with respect to the remainder of the process 400 (i.e., starting at step 420), because the remainder of the process 400 is substantially independent of the manner in which the target color coordinate was calculated. The target color coordinate is then stored to memory (step 420) and the process 400 proceeds to section AA shown in and described with respect to FIG. 5.

Figure 5:
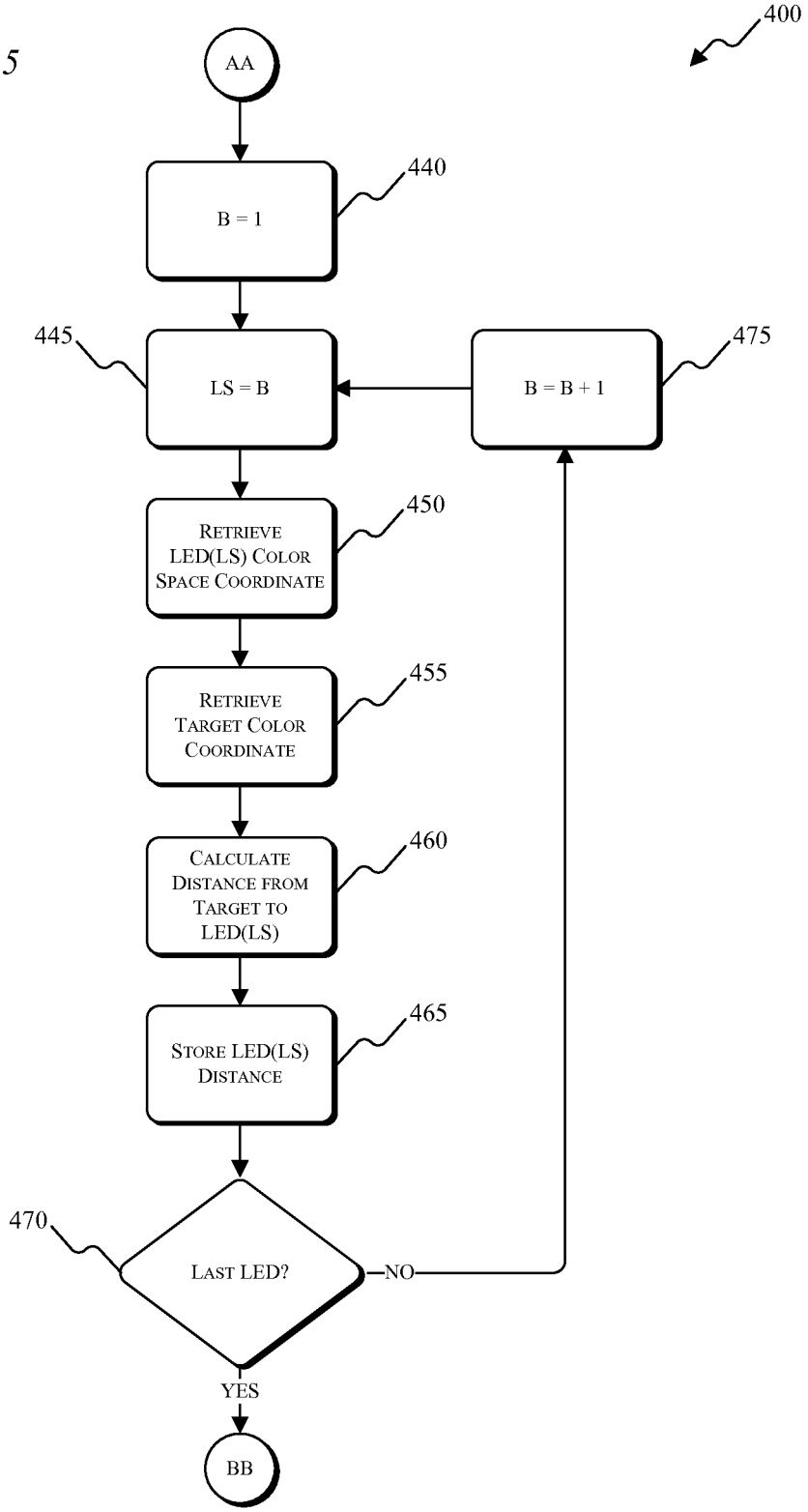

With reference to FIG. 5, a second variable, B, is initialized or set equal to one (step 440), and the light source variable, LS, is set equal to B (e.g., the first light source) (step 445). The light fixture 100, or a controller connected to the light fixture 100, uses stored spectral information for each of the light sources within the light fixture 100 (e.g., output intensities of the light sources with respect to wavelength) to determine a location for each light source within a particular color space (e.g., the CIE xyY color space 300). The spectral data for each of the light sources is sampled or gathered, for example, at the time of manufacture and stored in a memory. The spectral data is stored in a memory of the light fixture as a table or multiple tables of values. The values associated with the tables are accessed or retrieved to calculate an output of the light fixture (e.g., as a coordinate within a color space) without having to activate the light sources and use light sensors. The coordinates are also stored in memory, and can be accessed from memory for comparison to one or more additional calculated coordinates within a color space (e.g., the target color coordinate). In some implementations, the spectral data is gathered, stored, and utilized in a manner similar to that described in U.S. patent application Ser. No. 12/898,127, filed Oct. 5, 2010 and titled "SYSTEM AND METHOD FOR COLOR CREATION AND MATCHING," the entire content of which is hereby incorporated by reference.

At step 450, the color space coordinate for the selected light source is retrieved from memory. The target color coordinate is also retrieved from memory (step 455). The distance between the target color coordinate and the color space coordinate for the first light source is then calculated (step 460). For example, if the target color coordinate is designated by an x-coordinate, $x_T$, and a y-coordinate, $y_T$, and the first light source is designated by an x-coordinate, $x_1$, and a y-coordinate, $y_1$, the distance, $D_1$, between the target color coordinate and the first light source coordinate can be calculated as shown below in EQN. 21. EQN. 21 can be used to calculate the distance between each of the light sources in the light fixture and the target color coordinate.

$$D_1 = \sqrt{(x_T - x_1)^2 + (y_T - y_1)^2} \quad \text{EQN. 21}$$

The calculated distance, $D_1$, for the first light source is then stored in memory (step 465). The selected light source corresponding to the second variable, B, is compared to the number of LEDs in the light fixture (step 470). If the selected light source is not the last light source in the light fixture, the second variable, B, is incremented by one (step 475) and the light source variable, LS, is reset to the new value of the second variable, B (step 445). If the selected light source is the last light source in the light fixture, the process 400 proceeds to section BB shown in and described with respect to FIG. 6.

The locations described herein generally relate to positions or coordinates within a color space that can be used to map colors in one, two, or three dimensional space, and allow for the consistent identification of colors. Implementations and constructions of the invention are described herein with respect to the CIE xyY color space, but other color spaces can also be used. The separations between the locations within the color space are described generally with respect to distances. However, the separations can also be based on, for example, ratios, products, sums, or differences between wavelengths, frequencies, intensities, polarizations, phases, color temperature, brightness, saturation, etc., and correspond generally to an intervening space or gap between points, values, quantities, objects, locations, and the like.

Figure 6:
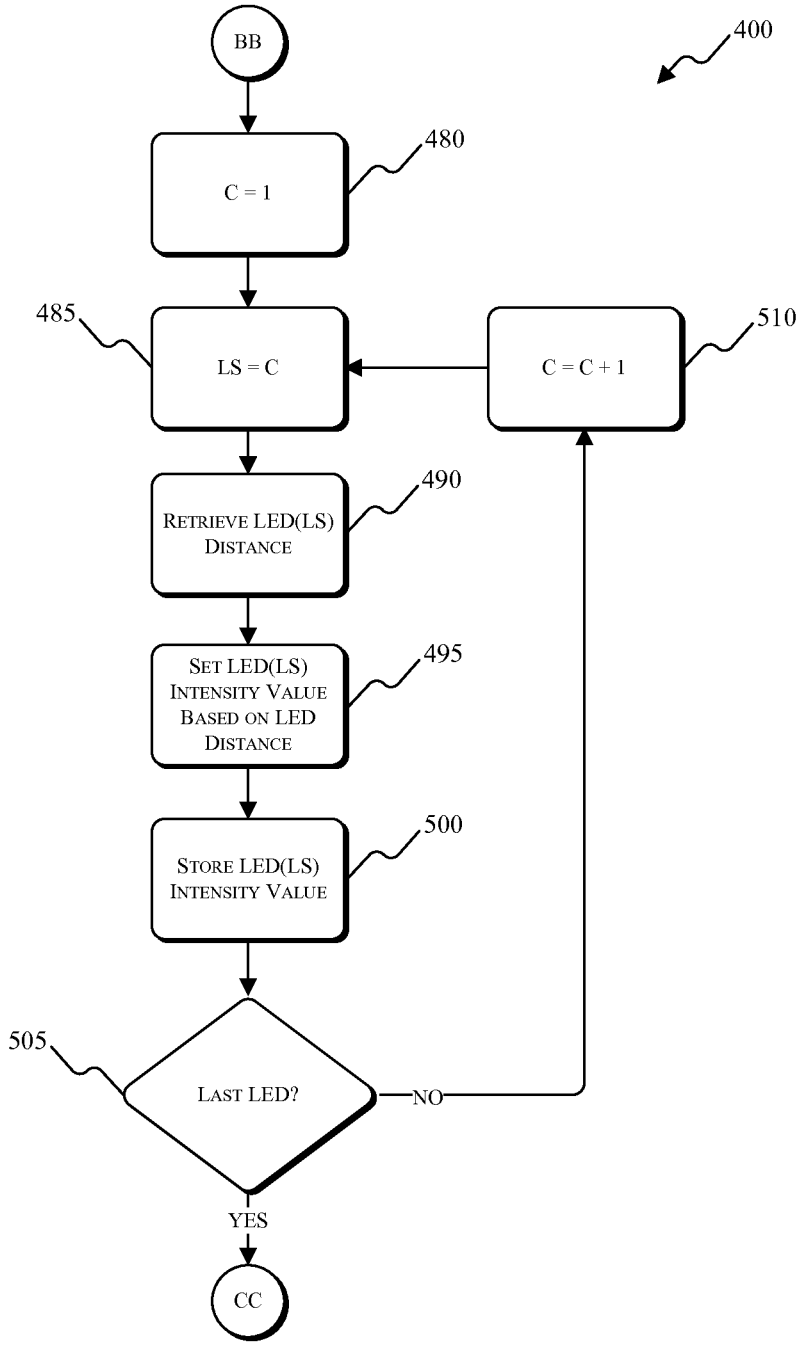

With reference to FIG. 6, a third variable, C, is initialized or set equal to one (step 480), and the light source variable, LS, is set equal to C (e.g., the first light source) (step 485). At step 490, the distance between the first light source and the target color coordinate is retrieved from memory. An intensity level for the first light source is then set based on the retrieved distance (step 495), and the intensity level is stored to memory (step 500). For example, the greater the distance between the light source color space coordinate and the target color coordinate, the lower the initial intensity value is set. As such, the distance between the light source color space coordinate, and the target color coordinate and the initial output intensity value for the light source are inversely related. In some implementations, the inverse relationship is a linear inverse relationship. In other implementations, the inverse relationship is an exponential, logarithmic, or the like. The light source intensities are, for example, one byte. Therefore, each light source intensity has a value between 0 (i.e., no output) and 255 (i.e., full-scale). After the initial output intensity value for light source is set, the selected light source corresponding to the third variable, C, is compared to the number of LEDs in the light fixture (step 505). If the selected light source is not the last light source in the light fixture, the third variable, C, is incremented by one (step 510) and the light source variable, LS, is reset to the new value of the third variable, C (step 485). If the selected light source is the last light source in the light fixture, the process 400 proceeds to section CC shown in and described with respect to FIG. 7.

Figure 7:
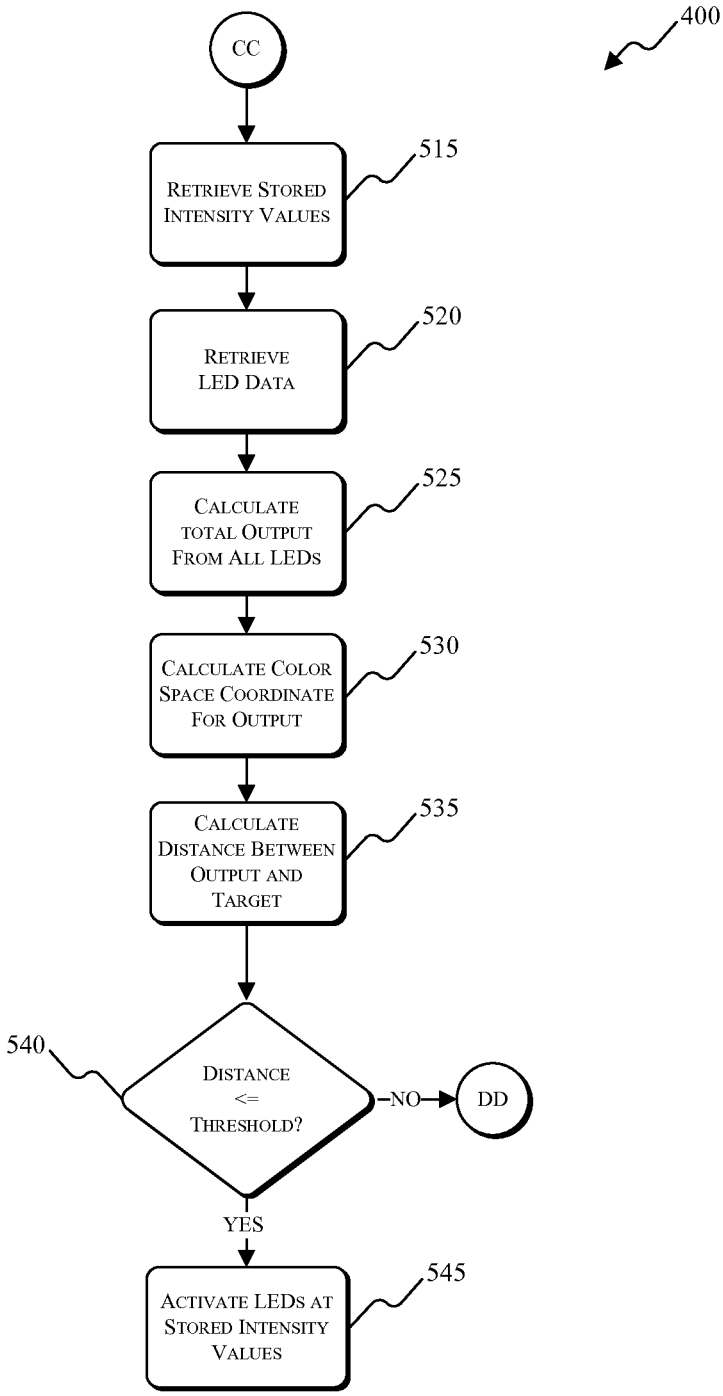

At step 515 shown in FIG. 7, all of the light source intensity values are retrieved or accessed from memory. The stored LED data is also retrieved from memory (step 520) such that the total output of the light fixture (i.e., the output of each light source) can be calculated (step 525). For example, the output intensity of each light source with respect to wavelength is determined based on the initial output intensity values for each light source and the LED data. The output intensities of each light source are then combined to produce a set of data corresponding to the total output for the light fixture. The total output of the light fixture is then used to calculate a color space coordinate (step 530) for the total output of the light fixture based on the initial light source output intensity values and the color matching functions described above. The distance between the total light fixture output color space coordinate and the target color coordinate is then calculated (step 535) using, for example, EQN. 21 above. The distance calculated at step 535 is compared to a threshold value (step 540). The threshold value is, for example, a distance value, a percent-error value, a mean square error ("MSE"), or the like. If the distance is not less than or equal to the threshold value, the process 400 proceeds to section DD shown in and described with respect to FIG. 8. If the initial output intensity values for the light sources resulted in a light fixture output color space coordinate that was less than or equal to the threshold value, the light sources are driven or activated at the stored initial output intensity values (step 545).

Figure 8:
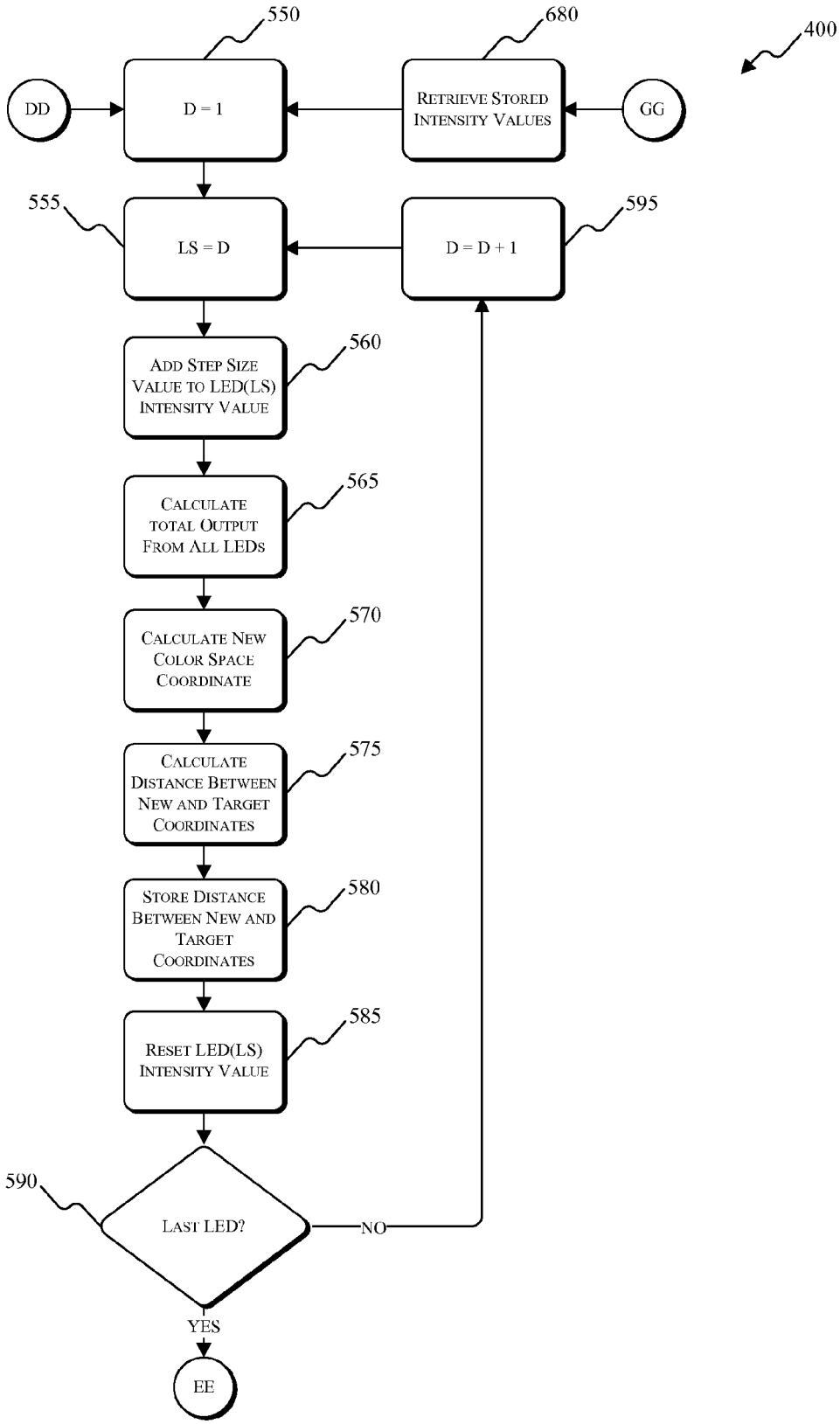

With reference to FIG. 8 and step 550, a fourth variable, D, is initialized or set equal to one, and the light source variable, LS, is set equal to D (e.g., the first light source) (step 555). At step 560, a step size value is added to the output intensity value of the selected light source. The step size value is based on, for example, the separation or distance between the total light fixture output color space coordinate and the target color coordinate (e.g., the step size value is proportional to the separation between the total light fixture output color space coordinate and the target color coordinate). For example, if the distance between the total light fixture output color space coordinate and the target color coordinate is greater than or equal to one or more threshold values, the step size value is set proportionally large. If the distance between the total light fixture output color space coordinate and the target color coordinate is less than or equal to one or more threshold values, the step size value is set proportionally small. In some implementations, the step size value is a percentage value, an incremental intensity value, or the like. For example, if the step size value is 5%, the output intensity value for the light source is increased by 5%. Using the new output intensity value for the selected light source, the previously retrieved initial output intensity values for the remaining light sources (i.e., the un-modified initial output intensity values), and the previously retrieved LED data, the total output of the light fixture is recalculated (step 565). The color space coordinate for total light fixture output is also recalculated (step 570). The distance between the new color space coordinate for the total light fixture output and the target color coordinate is calculated (step 575), and the distance between the new color space coordinate for the total output and the target color coordinate is stored to memory (step 580). The output intensity value for the selected light source is then reset to the previous (i.e., un-modified) output intensity value (step 585). The selected light source corresponding to the fourth variable, D, is compared to the number of LEDs in the light fixture (step 590). If the selected light source is not the last light source in the light fixture, the fourth variable, D, is incremented by one (step 595) and the light source variable, LS, is reset to the new value of the fourth variable, D (step 555). The process 400 repeats steps 560-590 until the step size value has been added to each output intensity value for the light sources. If the selected light source is the last light source in the light fixture, the process 400 proceeds to section EE shown in and described with respect to FIG. 9.

Figure 9:
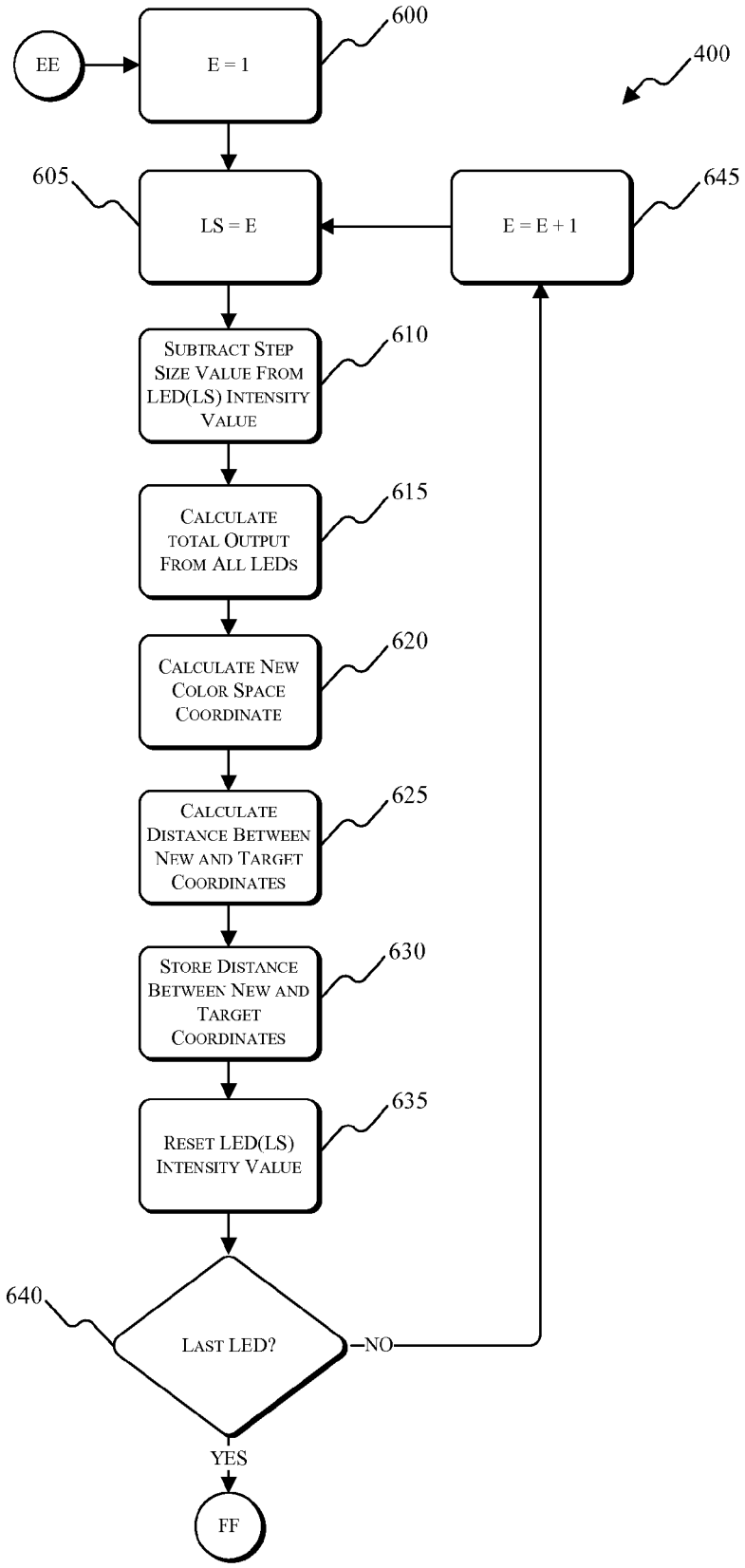

At step 600 in FIG. 9, a fifth variable, E, is initialized or set equal to one, and the light source variable, LS, is set equal to the fifth variable, E (e.g., the first light source) (step 605). At step 610, a step size value is subtracted from the output intensity value of the selected light source. As described above, in some implementations, the step size value is based on the separation or distance between the total light fixture output color space coordinate and the target color coordinate, and the step size value is a percentage value, a decremental intensity value, or the like. For example, if the step size value is 5%, the output intensity value for the light source is decreased by 5%. Using the new output intensity value for the selected light source, the previously retrieved initial output intensity values for the remaining light sources, and the previously retrieved LED data, the total output of the light fixture is recalculated (step 615). The color space coordinate for total light fixture output is also recalculated (step 620). The distance between the new color space coordinate for the total light fixture output and the target color coordinate is calculated (step 625), and the distance between the new color space coordinate for the total output and the target color coordinate is stored in memory (step 630). The output intensity value for the selected light source is then reset to the previous output intensity value (step 635). The selected light source corresponding to the fifth variable, E, is compared to the number of LEDs in the light fixture (step 640). If the selected light source is not the last light source in the light fixture, the fifth variable, E, is incremented by one (step 645), and the light source variable, LS, is reset to the new value of the fifth variable, E (step 605). The process 400 repeats steps 610-640 until the step size value has been subtracted from each output intensity value for the light sources. If the selected light source is the last light source in the light fixture, the process 400 proceeds to section FF shown in and described with respect to FIG. 10. In some implementations, the addition and subtraction of the step size value to the output intensity of each light source are performed consecutively as opposed to adding the step size value to the output intensity of each LED source and then subtracting the step size value from each light source. In other implementations, subtraction of the step size value is performed before the addition of the step size value. Additionally or alternatively, the step size value varies between the addition and subtraction or from light source to light source based on, for example, initial intensity values, a calculated distance, or another feedback criterion.

Figure 10:
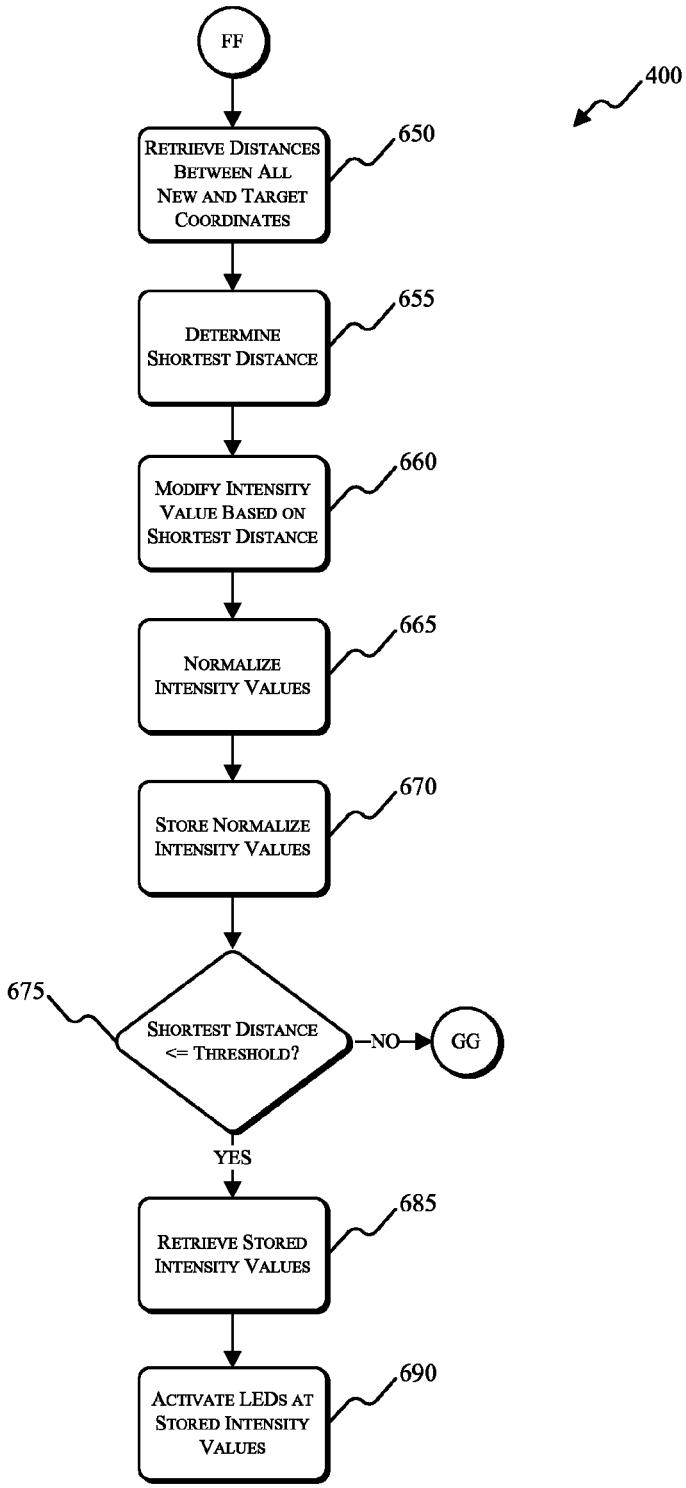

With reference to FIG. 10, after the step size value has been added to and subtracted from the stored intensity values for each of the light sources, the stored distances associated with total light fixture output for each of the modified intensity values are retrieved or accessed from memory (step 650). For example, a seven light source light fixture has fourteen distance values stored in memory corresponding to the addition and subtraction of a step size value from the stored output intensity values for each light source. The retrieved distances are then compared to one another to determine the shortest distance (step 655). The shortest distance value corresponds to the set of output intensity values that resulted in the least amount of error (i.e., the addition or subtraction of the step size value that resulted in the most beneficial change in the output of the light fixture). After the shortest distance has been identified, the stored output intensity values are modified (step 660) to correspond to the output intensity values that produced the shortest distance. For example, the step size value is added to or subtracted from a single output intensity value.

After the step size value has been added to or subtracted from the output intensity value, the output intensity values of each of the light sources are normalized (step 665). For example, modifying the output intensity values as described above can result in each of the light sources having an output intensity value of less than 100.0%. In such an instance, the light source or light sources having the highest output intensity value are normalized to a 100.0% output intensity value. As an illustrative example, a light fixture including seven light sources has output intensity values for each of the light sources (following step 660) as shown below in Table #1. Because the green light source has the highest output intensity value (i.e., 80.0%), the output intensity value of the green light source is reset to an output intensity value of 100.0%. The increase in the output intensity value of the green light source is 25.0% based on the un-normalized output intensity value. As such, the output intensity values of each of the remaining light sources are also increased by 25.0% based on the un-normalized output intensity values. For example, the red light source has an un-normalized output intensity value of 40.0%. Increasing the output intensity by 25.0% results in a normalized output intensity value of 50.0%. The output intensity values of the light sources are normalized to ensure or at least approximate the combination of light source output intensity values that produces a maximum lumen output (i.e., a maximum luminous flux) for the light fixture. Although the step of normalizing the light source output intensity values is shown following step 660, the output intensity values can be normalized in the same or a similar manner later in the process 400 (e.g., following step 670, step 675, or step 685 (all described below)).

TABLE #1

| Normalized Light Source Output Intensity Values | | |
|---|---|---|
| Color | Un-Normalized Intensity | Normalized Intensity |
| Red | 40.0% | 50.0% |
| Red-Orange | 50.0% | 62.5% |
| Amber | 60.0% | 75.0% |

TABLE #1-continued

| Normalized Light Source Output Intensity Values | | |
|---|---|---|
| Color | Un-Normalized Intensity | Normalized Intensity |
| Green | 80.0% | 100.0% |
| Cyan | 30.0% | 37.5% |
| Blue | 10.0% | 12.5% |
| Indigo | 20.0% | 25.0% |

The new output intensity values corresponding to that light sources are then stored in memory (step 670). The shortest distance is then compared to the threshold value (step 675). Because the normalization described above modified the output intensities of the light sources by the same amount, the ratios of the light source intensities remain the same. As such, the shortest distance that was determined at step 655 remains unchanged and does not need to be recalculated following the normalization of step 665. As described above, the threshold value is, for example, a distance value, a percent-error value, or the like. If the distance is not less than or equal to the threshold value, the process 400 proceeds to section GG shown in and described with respect to FIG. 8 where the new intensity values are retrieved from memory (step 680) and a step size value is again added to and subtracted from the new stored output intensity values. If the distance is less than the threshold value, the new light source intensity values are retrieved or accessed from memory (step 685), and the light sources are driven or activated at the stored output intensity values (step 690). Additionally, because the process 400 is capable of being executed by the light fixture itself and no powerful central computer is required, each light fixture in a system of light fixtures is capable of executing the process 400 in a parallel manner.

The process 400 can be performed or executed following, for example, receiving a set of input parameters, a determined change in the intensity value, a determined change in the white point, or the like. As such, additional modified target color points can be calculated based on a modification to the intensity value and without modification to the desired target color. For example, after a first modified target color coordinate has been identified, a change in the intensity value causes, among other things, a new white point color temperature and white point color coordinate to be identified, a new color temperature transformation to be selected, and a new modified target color coordinate to be calculated. Additionally or alternatively, the process 400 can be preformed each time a signal related to the input parameters is received (e.g., even if none of the values associated with those signals have changed).

Thus, the invention provides, among other things, systems and methods for controlling an output of a light fixture to mimic the color temperature changes of an ideal black-body radiator. Various features and advantages of the invention are set forth in the following claims.

What is claimed is:

1. A method of controlling an output of a light fixture, the light fixture including four or more light sources, the method comprising:

receiving a first input parameter corresponding to a first color point within a color space;

receiving a second input parameter associated with a desired intensity for the first color point;

determining a white point based on a relationship between the second input parameter and the color temperature of a black-body radiator, the white point corresponding to a second color point within the color space;

selecting a color temperature transform based on the white point;

calculating a third color point within the color space based on the color temperature transform, the color temperature transform defining a relationship between the first color point and the third color point, the third color point being different than the first color point, and the third color point being different than the second color point;

determining a respective light source output value for each of the four or more light sources based on the third color point; and driving each of the four or more light sources at the respective light source output value to produce the output of the light fixture.

2. The method of claim 1, wherein the relationship between the second input parameter and the color temperature of the black-body radiator includes a linear approximation of the color temperature of the black-body radiator.

3. The method of claim 1, wherein the second color point substantially lies on the Planckian locus, the first color point does not substantially lie on the Planckian locus, and the third color point does not substantially lie on the Planckian locus.

4. The method of claim 1, further comprising receiving a third input parameter associated with a second desired intensity of the first color point; and determining a second white point based on a relationship between the third input parameter and the color temperature of the black-body radiator, the second white point corresponding to a fourth color point within the color space.

5. The method of claim 4, further comprising selecting a second color temperature transform based on the second white point; and calculating a fifth color point within the color space based on the second color temperature transform, the second color temperature transform defining a relationship between the third color point and the fifth color point, the fifth color point being different than the third color point, and the fifth color point being different than the fourth color point.

6. The method of claim 5, further comprising determining a second respective light source output value for each of the four or more light sources based on the fifth color point; and driving each of the four or more light sources at the second respective light source output value to produce the output of the light fixture.

7. The method of claim 5, wherein the fourth color point substantially lies on the Planckian locus and the fifth color point does not substantially lie on the Planckian locus.

8. A method of controlling an output of a light fixture, the light fixture including four or more light sources, the method comprising:

receiving a set of input parameters, the set of input parameters corresponding to a first color point within a color space and an intensity for the first color point;

determining a color temperature setting based on a relationship between the set of input parameters and the color temperature of a black-body radiator, the color temperature setting corresponding to a second color point within the color space;

determining a color temperature transform based on the color temperature setting;

calculating a third color point within the color space based on the color temperature transform, the color temperature transform defining a relationship between the first color point and the third color point, the third color point being different than the first color point, and the third color point being different than the second color point;

determining a respective light source output value for each of the four or more light sources based on the third color point; and driving each of the four or more light sources at the respective light source output value to produce the output of the light fixture.

9. The method of claim 8, wherein the second color point substantially lies on the Planckian locus, the first color point does not substantially lie on the Planckian locus, and the third color point does not substantially lie on the Planckian locus.

10. The method of claim 8, further comprising receiving a second set of input parameters corresponding to the first color point and a second intensity for the first color point; and determining a second white point based on a relationship between the second set of input parameters and the color temperature of the black-body radiator, the second white point corresponding to a fourth color point within the color space.

11. The method of claim 10, further comprising selecting a second color temperature transform based on the second white point; and calculating a fifth color point within the color space based on the second color temperature transform, the second color temperature transform defining a relationship between the third color point and the fifth color point, the fifth color point being different than the third color point, and the fifth color point being different than the fourth color point.

12. The method of claim 11, further comprising determining a second respective light source output value for each of the four or more light sources based on the fifth color point; and driving each of the four or more light sources at the second respective light source output value to produce the output of the light fixture.

13. The method of claim 11, wherein the fourth color point substantially lies on the Planckian locus and the fifth color point does not substantially lie on the Planckian locus.

14. A system for controlling the output of a light fixture, the system including:

four or more light sources; and a controller configured to receive a first input parameter corresponding to a first color point within a color space, receive a second input parameter associated with a desired intensity for the first color point, determine a white point based on a relationship between the second input parameter and the color temperature of a black-body radiator, the white point corresponding to a second color point within the color space, select a color temperature transform based on the white point, calculate a third color point within the color space based on the color temperature transform, the color temperature transform defining a relationship between the first color point and the third color point, the third color point being different than the first color point, and the third color point being different than the second color point, determine a respective light source output value for each of the four or more light sources based on the third color point, and drive each of the four or more light sources at the respective light source output value to produce the output of the light fixture.

15. The system of claim 14, wherein the relationship between the second input parameter and the color temperature of the black-body radiator includes a linear approximation of the color temperature of the black-body radiator.

16. The system of claim 14, wherein the second color point substantially lies on the Planckian locus, the first color point does not substantially lie on the Planckian locus, and the third color point does not substantially lie on the Planckian locus.

17. The system of claim 14, wherein the controller is further configured to receive a third input parameter associated with a second desired intensity of the first color point, and determine a second white point based on a relationship between the third input parameter and the color temperature of the black-body radiator, the second white point corresponding to a fourth color point within the color space.

18. The system of claim 17, wherein the controller is further configured to select a second color temperature transform based on the second white point, and calculate a fifth color point within the color space based on the second color temperature transform, the second color temperature transform defining a relationship between the third color point and the fifth color point, the fifth color point being different than the third color point, and the fifth color point being different than the fourth color point.

19. The system of claim 18, wherein the controller is further configured to determine a second respective light source output value for each of the four or more light sources based on the fifth color point, and drive each of the four or more light sources at the second respective light source output value to produce the output of the light fixture.

20. The system of claim 18, wherein the fourth color point substantially lies on the Planckian locus and the fifth color point does not substantially lie on the Planckian locus.

* * * * *